US005393124A

United States Patent [19]

Neil

[11] Patent Number: 5,393,124

[45] Date of Patent: Feb. 28, 1995

[54] ARMREST ASSEMBLY

[76] Inventor: Gary K. Neil, 1137 Vicki Lane, Mississauga, Ontario, Canada, L5C 2X9

[21] Appl. No.: 987,790

[22] Filed: Dec. 9, 1992

[51] Int. Cl.[6] ..... A47C 7/54

[52] U.S. Cl. ..... 297/411.35; 297/411.36; 297/116

[58] Field of Search ..... 297/416, 417, 412, 422, 297/116, 411.35, 411.36

[56] References Cited

U.S. PATENT DOCUMENTS

| | | | |
|---|---|---|---|
| 2,592,702 | 4/1952 | Sprung | 297/417 |
| 3,382,000 | 5/1968 | Sully | 297/422 |
| 3,829,159 | 8/1974 | Leffler | 297/417 |
| 4,270,798 | 6/1981 | Harder, Jr. | 297/417 |
| 4,822,103 | 4/1989 | Stenvall | 297/412 |
| 4,961,610 | 10/1990 | Reeder et al. | 297/417 |
| 4,997,054 | 3/1991 | Denny et al. | 297/412 |
| 5,188,423 | 2/1993 | Meiller et al. | 297/412 |

FOREIGN PATENT DOCUMENTS

| | | | |
|---|---|---|---|
| 0166870 | 1/1986 | European Pat. Off. | 297/411 |
| 1805645 | 8/1970 | Germany | 297/411 |
| 3626897 | 2/1988 | Germany | 297/411 |

*Primary Examiner*—Peter M. Cuomo
*Assistant Examiner*—Darnell M. Boucher
*Attorney, Agent, or Firm*—Eugene J. A. Gierczak

[57] ABSTRACT

An armrest assembly for a chair comprising, an upper arm, support shaft structure associated with the upper arm, the support shaft presenting an axis of rotation for rotational movement of the upper arm, a structure associated with the chair for receiving the support shaft for relative rotational movement of the upper arm relative the receiving structure about the axis, and a structure for radially rotating the position of the upper arm about the axis of rotation to multiple positions as required for the user's comfort.

17 Claims, 3 Drawing Sheets

ARMREST ASSEMBLY

FIELD OF INVENTION

This invention relates to an armrest assembly and more particularly relates to a chairarm which has an armrest which is rotatable in a substantially horizontal plane about the support shaft to any of a number of positions and which is vertically moveable to a multitude of pre-designated heights, allowing the user to customize the position for their comfort thereby providing the user with additional support to the arms, forearms, wrists and shoulders in order to alleviate repetitive stress injuries when the user is keyboarding or involved in other keying or similar activities while sitting in a chair equipped with the armrest assembly.

BACKGROUND TO THE INVENTION

Various apparatus which support human forearms and wrists have heretofore been devised.

For example U.S. Pat. No. 5,072,905 (Hyatt) discloses an apparatus for clamping to a table or desk to support the wrist and forearm of a person. The wrist and forearm support apparatus comprises a cushioned wrist support member having a pair of cushioned armrest members, pivotally connected thereto for adjustment to angular positions providing optimal support for an individual user, and a clamping mechanism disposed at forward ends of the armrests support members for attaching the wrist support member and the armrest as a unitary structure to the edge of a table or desk.

Furthermore, U.S. Pat. No. 4,576,351 (Brink) discloses a portable stroke victim's armrest which provides a multi-positional means of comfort for the victim's arm and in particular to prop the victim's arm at an incline to prevent accumulation of fluids in the hand and wrist area. The portable stroke victim's armrest comprises a support member having a generally horizontal shelf member and a generally vertical brace member emanating downwardly therefrom at substantially right angles from one side of the shelf member, a "U"-shaped height adjusting member operatively mounted with said support member being adapted to securely position the portable stroke victim's armrest on the arm of a chair, sofa, or the like and further adapted to raise and lower the ends of the support member to achieve various heights and angles, a stub-shaft located medially between the ends of the leg members, connected therebetween and forming with leg members a guide for stably receiving an arm of a chair, a contoured cushion arm support movably coupled to the support member including a cushioned substantially horizontal support and a cushioned upwardly extending wall along the horizontal support outer edge and being substantially at right angles therewith, a substantially horizontal support evolving into an elevated arcuate end portion which is contoured for and accommodates the hand and wrist area in an elevated position with respect to horizontal to thereby enhance the natural gravity encouraged flow of fluids necessary to the physical well-being of stroke victims.

Furthermore, U.S. Pat. No. 4,575,152 (McLaughin) discloses a padded member and method of making same. This patent relates to a padded member including a beam support enclosed in a cushion and a method of making the padded member. The method includes providing a core having a projecting portion and partially encircled by a sleeve to assume the shape of a beam support and molding a cushion about the core and sleeve to form an opening in the cushion spaced from the sleeve and a flexible cushion portion adjacent the opening accompanying flexing of the cushion for removal from the core and application to a beam support.

Furthermore, U.S. Pat. No. 3,950,027 (Wilson) an armrest for a dental chair. This patent discloses an adjustable armrest which can be rotated ninety degrees in a horizontal plane about a vertical axis to permit easier entry and exit of a patient to and from the dental chair. The armrest is automatically locked at either the forward position or the ninety degree position and is unlocked by lifting vertically on the armrest. A single set screw connects the armrest to the dental chair.

Furthermore, U.S. Pat. No. 4,025,112 (Hale) discloses a medical stool. This patent comprises a seat, framework means connected to and supporting the seat, and an armrest or equipment support being connected by an intermediate generally horizontally disposed member which is joined to the support frame and the underside of the armrest or equipment support by connectors. When the interrelationship of the connectors is compressed, rotation at the connector is obviated, whereas the opposite is true when the connectors are relatively loose, the connectors accommodating ready separation of the armrest from the intermediate member and the intermediate member from the support frame.

Furthermore, U.S. Pat. No. 4,277,102 (Aaras et al) discloses a chair having a seat portion, a back rest and armrest. The armrests are individually supported on arms mounted on the seat support member. The connection of the armrest to the support arms and the support arms to the seat body is through the use of universal joints allowing movement in all directions.

Moreover, U.S. Pat. No. 4,822,103 (Stenvall) discloses an armrest device for relieving loads when performing work by hand and wrist movement. This patent comprises an attachment member for mounting the armrest on a chair, an upper support for supporting the forearm and arranging to be self-positioned while supporting the forearm and work being performed by hand and wrist movements, the support accompanying the hand and wrist movements, an adjustable horizontal guide rail attached to said upper support and movably disposed in longitudinal direction to provide a corresponding adjustment of said support due to the influence of a force generated when the hand is moved forwards or backwards. An adjustable vertical guide rail which is moveable in its longitudinal direction to provide a corresponding adjustment of said support due to the influence of the force generated by the weight of the forearm and by external forces exerted on the forearm.

Finally, U.S. Pat. Nos. 2,950,890 (Hough), 4,688,862 (Fowler et al), 4,482,064 (Berke et al), 4,482,063 (Berke et al) and 4,621,781 (Springer) are all patents which relate to armrests for attachment to office equipment.

Each of the prior devices referred to above present relatively complicated structures having relatively limited use.

It is an object of this invention to produce an improved armrest structure which substantially alleviates repetitive stress injury such as carpal tunnel syndrome.

Repetitive stress injury such as carpal tunnel syndrome is most likely to emerge in individuals engaged in prolonged keyboarding, or other keying-type activities having similar repetitive motion functions. Repetitive stress injuries have large costs associated with them both to the individual having the disorder and to their employer. Recent studies have also disclosed that repetitive stress injuries such as carpal tunnel syndrome are on the increase in North America and that in most cases the disorder is irreversible.

Other objects of the invention will appear hereinafter.

The broadest aspect of this invention relates to an armrest assembly for a chair comprising; a lower arm; an upper arm overlying said lower arm; support shaft means depending from said upper arm, said support shaft means presenting an axis of rotation, for rotational movement of said upper arm about said axis; a support shaft housing associated with said lower arm for receiving said support shaft means for combined rotational and axial movement of said upper arm relative said lower arm about said axis.

It is another aspect of this invention to provide an armrest assembly for a chair comprising; an upper arm having a from end and a back end; support shaft means associated with said upper arm adjacent said front end of said arm, said support shaft means presenting an axis of rotation, for rotational movement of said upper arm about said axis, said support shaft means having: series of multiple depressions at one end of said support shaft means, aligned such that there are four aligned rows having three radially spaced depressions about said axis of rotation, said multiple depressions having a generally circular cross-section; and multiple recesses at another end of said support shaft means; a lower arm joined to said chair, said lower arm having a front end and back end; support shaft housing carried by said lower arm for receiving said support shaft means for relative rotational movement of said upper arm relative said support shaft means about said axis; said upper arm overlying said lower arm in a storage position; said upper arm being generally horizontally disposed relative said generally vertical support shaft means; said support shaft housing having one end closed by a cap, a spring located within said support shaft housing and an opening within said support shaft housing to receive a lever to interact with said recesses in said support shaft means; at another end one or more apertures in the portion of the support shaft housing which extends above the said lower arm, a locator ball received in each aperture, and a securing means encircling the outer radius of the shaft urging the said locator ball against the support shaft, and securing said locator ball in the said depressions on the said support shaft means when engaged, securing certain fixed positions of the said armrest and allowing the said upper arm to be locked and unlocked rotatably by force exerted rotatably on the said upper arm by said user; said lever located within a lever housing, said lever housing abutting said support shaft housing, said lever urging into said opening within said support shaft housing by a lever spring means located between said lever and said lever housing wall.

It is yet another aspect of this invention to provide an armrest assembly for a chair comprising; an upper arm presenting a front end and a back end, having a ridged support means disposed therein and wherein said armrest is cushioned; a lower arm presenting a front end and a back end having a support shaft housing and lever housing disposed therein; a support shaft means generally circular in cross section having at one end thereof, multiple recesses and at the other end thereof, multiple depressions having a generally circular cross section, the end having multiple depressions being affixed to the said rigid support disposed within the said upper arm and the other end placed into the said support shaft housing at said front end of said lower arm, said support shaft means presenting an axis of rotation; means for adjusting the distance of said upper arm relative said lower arm along said axis of rotation and having a support shaft housing disposed in said lower arm, said support shaft housing having one end closed by a cap means, a spring means located within said support shaft housing, and an opening within the wall of the support shaft housing to receive a lever which will interact with the said recesses in said support shaft means and having a lever housing, in said lower arm, said lever located within said lever housing, said lever urging into said opening within the wall of the support shaft housing by a spring means located between said lever and said lever housing wall; means for radially rotating the position of the said upper arm about said axis of rotation to multiple positions, the said support shaft housing having at one end thereof one or more apertures in the portion of the support shaft housing which extends above the said lower arm, a locator ball received in each aperture and a securing means encircling the outer radius of the support shaft housing urging the said locator ball against the support shaft, and securing said locator ball in the said depressions on the said support shaft means when engaged, securing certain fixed positions of the said armrest and allowing said upper arm to be locked and unlocked rotatably by force exerted rotatably on the said upper chair arm.

DESCRIPTION OF DRAWINGS

These and other objects and features shall now be described in relation to the following drawings in which.

DESCRIPTION OF THE INVENTION

Figure 1:
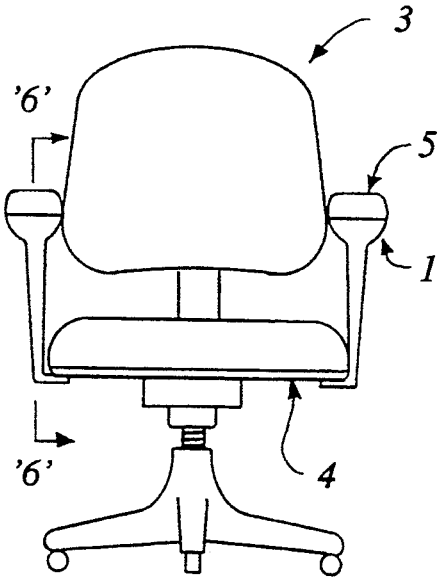
FIG. 1 is a front elevational view of a chair fabricated to incorporate the armrest assembly, the armrest assembly which is in the storage position.

Like parts shall be given identical numbers throughout the Figures. The armrest assembly is generally depicted by the numeral 1 and comprises an upper arm 12, and a lower arm 13 which are connected by a support shaft 15 which can be manipulated to adjust the height between the upper arm 12 and the lower arm 13. A two ball locator 55 which allows the upper arm to rotate in a generally horizontal plane relative its generally perpendicular vertical axis to a multitude of pre-designated positions which are statistically pre-determined user comfort positions, in order to support the arms, forearms, wrist and shoulders of the user to prevent repetitive stress injuries. It is understood that the form of the invention herein described is to be taken as a preferred embodiment, and that certain changes in the shape, size and arrangement may be made without departing from the spirit of the invention. Armrest assemblies traditionally vary in size, shape and style as they are designed to compliment the chair function, style and design to which they are to be affixed.

Figure 2:
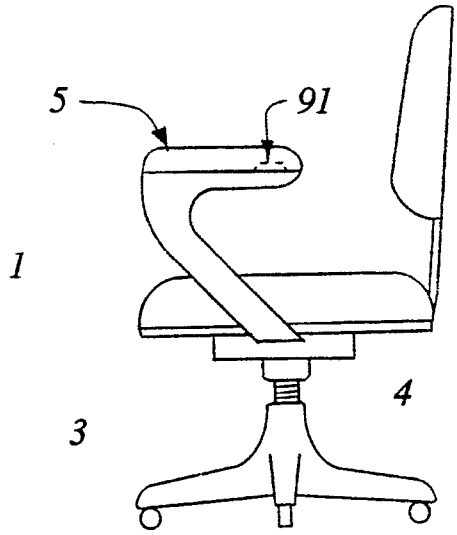
FIG. 2 is a side elevational view of a chair fabricated to incorporate the armrest assembly, the armrest assembly which is in the storage position.

Referring now to FIGS. 1 and 2, an armrest assembly 1 is mounted or secured to a chair 3. A variety of fastening methods could be used depending on the style and material of the chair frame 4, the preferred mounting method being welding the armrest assembly 1 to the chair frame 4. The upper arm 12 and the lower arm 13 mate in a storage position when the upper arm 12 overlies the lower arm 13. The armrest assembly 1 can be used individually or in conjunction with other armrest assemblies.

Figure 3:
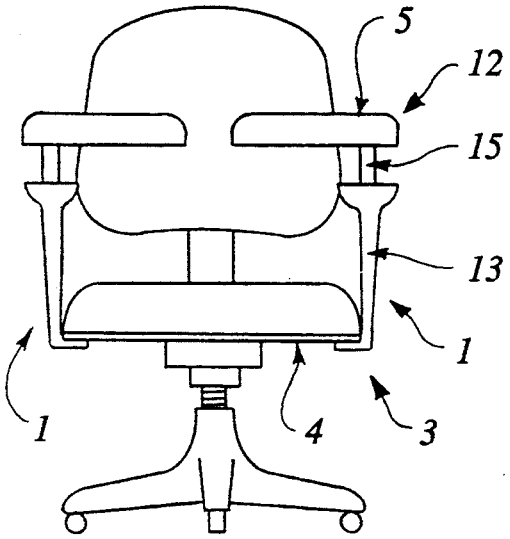
FIG. 3 is a front elevational view of a chair fabricated to incorporate the armrest assembly, the armrest assembly which is in the use position.
Figure 4:
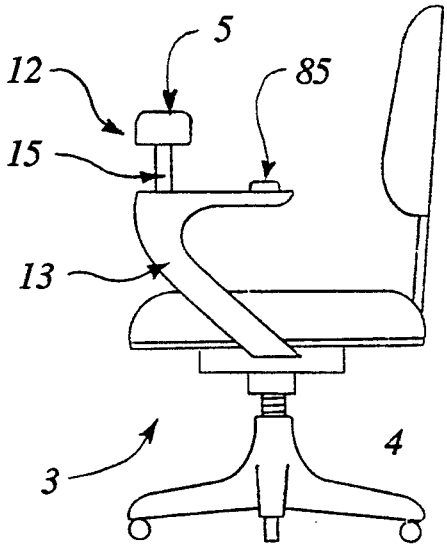
FIG. 4 is a side elevational view of a chair fabricated to incorporate the armrest assembly, the armrest assembly which is in the use position.
Figure 5:
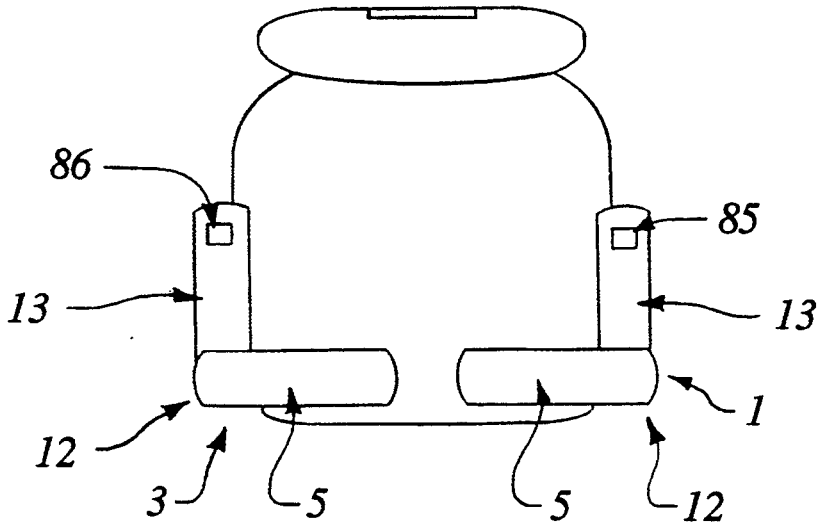
FIG. 5 is a top plan view of a chair fabricated to incorporate the armrest assembly, the armrest assembly which is in the use position.

Referring now to FIGS. 3, 4 and 5, there is shown an armrest assembly 1 in one of the multitude of use positions. The support shaft 15 connects the upper arm 12 to the lower arm 13. The upper arm 12 and lower arm 13 each have a corresponding front end and back end, the back end being located closest to the backrest of the chair. The support shaft 15 is disposed adjacent to the front end of the upper arm 12 and the support shaft housing is disposed adjacent to the front end of the lower arm 13.

Referring now to FIGS. 2, 4 and 5, there is shown the lower arm 13 having a nesting locator 85, 86 and the upper arm 12 having a nesting locator depression 91 which mate in a storage position, securing the upper arm 12 to the lower arm 13 in the storage position.

Figure 6:
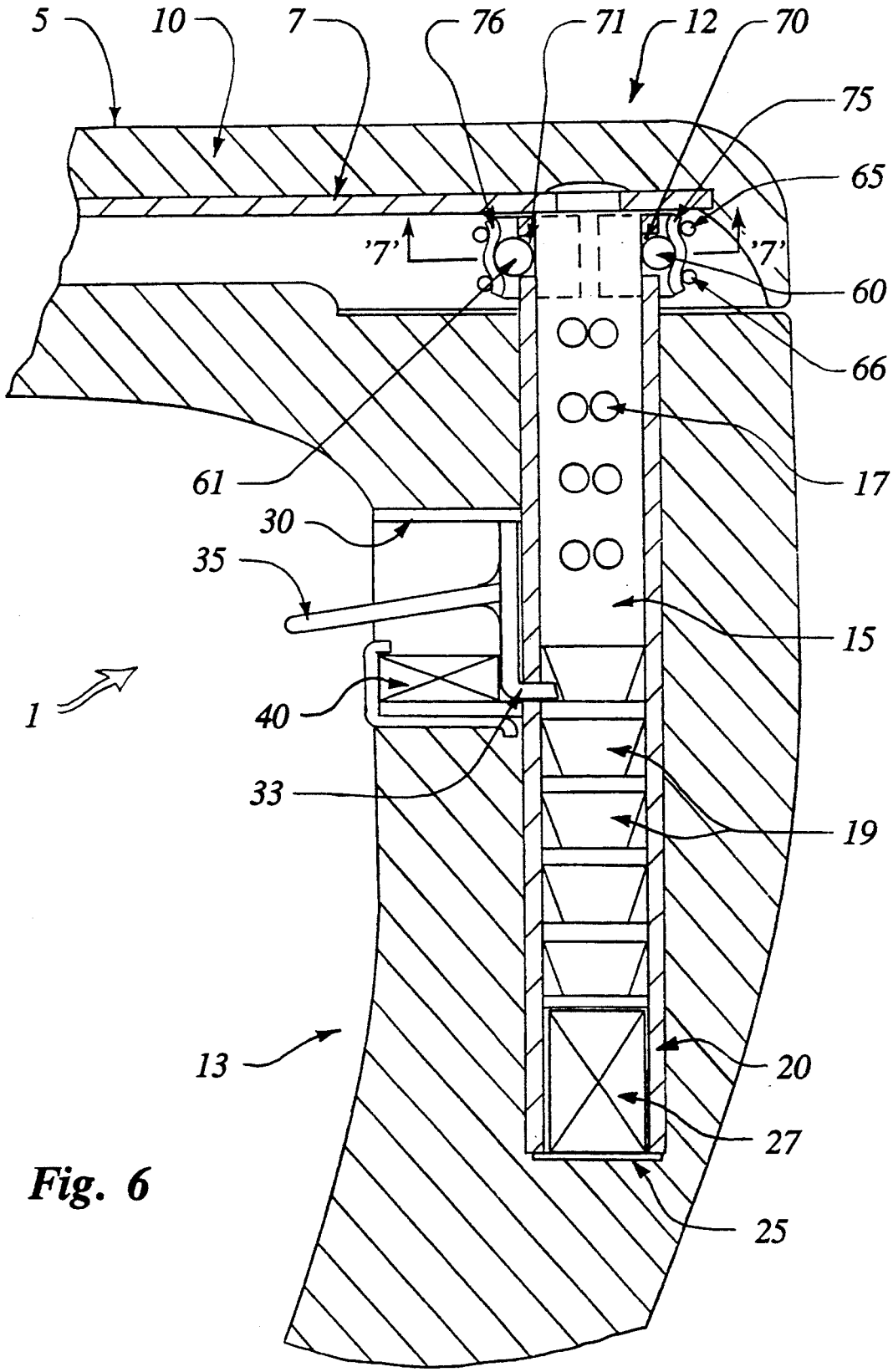
FIG. 6 is a cross-sectional view of said armrest assembly, along the line 6—6 of FIG. 1.

FIG. 6 illustrates the relationship between the upper arm 12 and lower arm 13. The upper arm 12 has an armrest rigid support 7 disposed internally for additional support, the armrest rigid support 7 being connected to the support shaft 15. The upper arm 12 may be cushioned 10, partially cushioned or may not be cushioned at all.

The support shaft 15 is generally circular in cross-section and has a series of rows of locator depressions 17. There are twelve (12) locator depressions 17, which are aligned axially in four (4) rows of three (3) radially spaced locator depressions 17. The number of locator depressions is only limited based on the available outside surface of the support shaft 15. The greater number of locator depressions 17 create a greater variety of lockable positions of the upper arm 12. The support shaft 15 has five (5) tapered grooves 19 which act as detents, and may have numerous tapered grooves 19. The greater number of tapered grooves 19 the greater number of height adjustments which can be made available.

The lower arm 13 has disposed within it vertically a receiving means or support shaft housing 20 which receives the support shaft 15. The support shaft housing 20 having a generally circular cross-section and having a diameter which is slightly larger than the diameter of the support shaft 15. The support shaft housing 20 has one end closed by a cap 25. Located within the support shaft housing 20, resting on the cap 25, is the support shaft spring 27 which exerts upward pressure on the support shaft 15. The support shaft housing 20 has a lever housing aperture 30 into which the lever 35 is inserted in order to interact with the support shaft tapered grooves 19. The lever housing 30 abuts to the support shaft housing 20 and houses a lever 35 and a lever spring 40. The lever spring 40 is placed horizontally between the lever 35 and the lever housing 30 exerting pressure on the lever 35 forcing engagement with the support shafts tapered grooves 19, thereby preventing the adjustment of the height of the upper arm 12 without the user activating the lever 35.

In order to adjust upwardly the height of the upper arm 12 the lever 35 is activated causing the lever 35 to exit the support shaft housing 20, allowing the support shaft spring 27 to exert an upward force on the support shaft 15 causing the support shaft 15 and upper arm 12 to move upward until the support shaft spring 27 is fully extended or the lever is engaged with the support shaft tapered grooves 19.

In order to lower the upper arm 12 the lever 35 must be activated causing it to exit from the support shaft housing 20, concurrently with the user or another individual exerting downward force on the upper arm 12 until desired level is achieved at which time the lever 35 should be released allowing it to return to its position within the support shaft housing 20, engaged with a support shaft tapered groove 19.

The support shaft housing 20 extends outwardly from the lower arm 13. Where the support shaft housing 20 is exposed there are two locator apertures 70, 71 into which are inserted locator balls 60, 61 respectively. A two piece semi-circular bracket 75, 76 is placed against the locator balls 60, 61 around the outside of the support shaft housing 20 and secured by an upper o-ring 65 and lower o-ring 66 which urges the semi-circular brackets 75, 76 against the locator balls 60, 61 and the locator balls 60, 61 against the support shaft 15.

Figure 7:
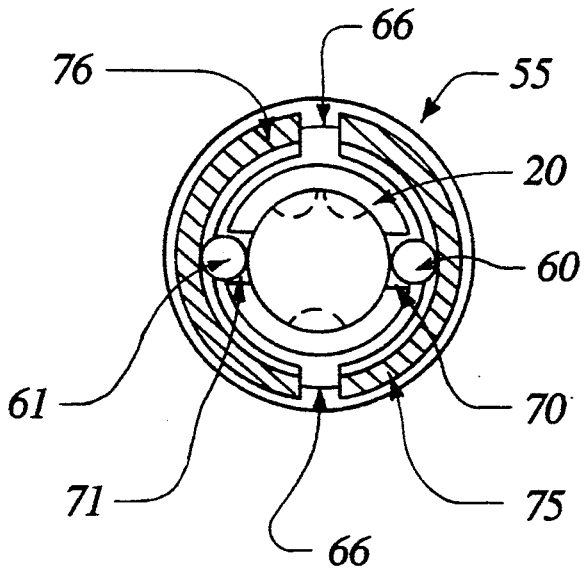
FIG. 7 is a cross-sectional view of the support shaft and locator means along line 7—7 of FIG. 6.

Referring now to FIG. 7 there is shown a two ball locator 55 comprising two (2) locator balls 60, 61 which are placed into the locator apertures 70, 71 on the support shaft housing 20 and secured in place by a two piece semi-circular bracket 75, 76 which are secured by o-rings 65, 66 causing the locator balls 60, 61 to be urged against the support shaft 15. When the user wishes to rotatably move the upper arm 12, the user will exert force on the upper arm 12 in the direction in which they desire the upper arm 12 to be moved (clockwise or counter-clockwise). When the locator balls 60, 61 are received by the locator depressions 17 the upper arm 12 will lock into a stationary position. Should the user desire to change to another position, the user will exert force in the direction they wish to move the upper arm 12 dislodging the locator ball 60, 61 from the locator depression 17 and moving the upper arm 12 to the user's desired position.

Although the preferred embodiments as well as the operation and use have been specifically described in relation to the drawings, it should be understood that variations in the preferred embodiment can be achieved by a person skilled in the art without departing from the spirit of the invention. In particular the preferred embodiment herein includes an armrest assembly which is adjustable in radial rotation and in height. Another embodiment of this invention would only incorporate the radial rotation. It is therefore intended that the foregoing detailed description be regarded as illustrative rather than limiting and that it be understood that it is the following claims including all equivalents that are intended to define the scope of this invention. Accordingly, the invention should not be understood to be limited to the exact form revealed by the drawings.

The embodiments of the invention in which an exclusive property or privilege is claimed are defined as follows:

1. An armrest assembly for a chair comprising;
(a) a lower arm;
(b) an upper arm overlying said lower arm;
(c) support means depending from said upper arm, said support means presenting an axis of rotation, for rotational movement of said upper arm about said axis, said support means having:
(i) a series of multiple depressions at one end, and
(ii) multiple recesses at another end of said support means;
(d) a support shaft housing associated with said lower arm for receiving said support means for rotational and axial movement of said upper arm relative said lower arm about said axis, said support shaft housing presenting an aperture at one end thereof and an opening at another end thereof;
(e) a locator ball received by said aperture;
(f) means for urging said locator ball into said depressions for permitting said upper arm to be releasably rotatably locked relative said lower arm;
(g) lever means extending through said opening for releasable engagement with said recesses for axial movement of said upper arm relative said lower arm.

2. In an armrest assembly as claimed in claim 1 wherein said upper arm is co-extensive with said lower arm.

3. In an armrest assembly as claimed in claim 2 wherein said upper arm moves relative to said lower arm to preselected positions.

4. In an armrest assembly as claimed in claim 3 wherein said upper arm comprises an armrest which is generally horizontally disposed relative said generally vertical support means having a front end and a back end.

5. In an armrest assembly as claimed in claim 4 wherein said support means is disposed adjacent said front end of said armrest.

6. In an armrest assembly as claimed in claim 5 wherein the said armrest has a rigid support disposed therein.

7. In an armrest assembly as claimed in claim 6 wherein said rigid support is attached to said support means.

8. In an armrest assembly as claimed in claim 7 wherein said armrest is cushioned.

9. In an armrest assembly as claimed in claim 8 wherein said support means has a series of multiple depressions, aligned such that there are four axially aligned rows having three radially spaced depressions about said axis of rotation.

10. In an armrest assembly as claimed in claim 9 wherein said multiple depressions have a generally circular cross-section.

11. In an armrest assembly as claimed in claim 10 wherein there are five recesses in said support means.

12. In an armrest assembly as claimed in claim 11 wherein said lower arm has a front end and a back end, and has disposed therein a said support shaft housing which will accommodate said support means.

13. In an armrest assembly as claimed in claim 12 wherein said support shaft housing having one end closed by a cap means, a spring means located within said support shaft housing, and an opening within the wall of the support shaft housing to receive a lever which will interact with the said recesses in said support means.

14. In an armrest assembly as claimed in claim 13 wherein said lever is located within a lever housing, said lever housing abutting to said support shaft housing, said lever urging into said opening within the wall of the support shaft housing by a spring means located between said lever and said lever housing wall.

15. An armrest assembly for a chair comprising;
(a) an upper arm having a front end and a back end;
(b) support shaft associated with said upper arm adjacent said from end of said arm, said support shaft presenting an axis of rotation, for rotational movement of said upper arm about said axis, said support shaft having:
(i) series of multiple depressions at one end of said support shaft, aligned such that there are four aligned rows having three radially spaced depressions about said axis of rotation, said multiple depressions having a generally circular cross-section; and
(ii) multiple recesses at another end of said support shaft;
(c) a lower arm joined to said chair, said lower arm having a front end and back end;
(d) support shaft housing carried by said lower arm for receiving said support shaft for relative rotational movement of said upper arm relative said support shaft about said axis;
(e) said upper arm overlying said lower arm in a storage position;
(f) said upper arm being generally horizontally disposed relative said generally vertical support shaft.
(g) said support shaft housing having
(i) one end closed by a cap, a spring located within said support shaft housing and an opening within said support shaft housing to receive a lever to interact with said recesses in said support shaft;
(ii) at another end one or more apertures in the portion of the support shaft housing which extends above the said lower arm, a locator ball received in each aperture, and a securing means encircling the outer radius of the shaft urging the said locator ball against the support shaft, and securing said locator ball in the said depressions on the said support shaft when engaged, securing certain fixed positions of the said armrest and allowing the said upper arm to be locked and unlocked rotatably by force exerted rotatably on the said upper arm by said user;
(h) said lever located within a lever housing, said lever housing abutting said support shaft housing, said lever being urged into said opening within said support shaft housing by a lever spring means located between said lever and a wall of said lever housing.

16. In an armrest assembly as claimed in claim 15 wherein said securing means consist of two semi-circular brackets which are placed around the radius of the said support shaft and held in place by one or more o-ring fastening means.

17. An armrest assembly for a chair comprising;
an upper arm presenting a front end and a back end, having a rigid support disposed therein and wherein said armrest is cushioned;
a lower arm presenting a front end and a back end having a support shaft housing and lever housing disposed therein;

a support shaft generally circular in cross section having at one end thereof, multiple recesses and at the other end thereof, multiple depressions having a generally circular cross section, the end having multiple depressions being affixed to the said rigid support disposed within the said upper arm and the other end placed into the said support shaft housing at said front end of said lower arm, said support shaft presenting an axis of rotation;

means for adjusting the distance of said upper arm relative said lower arm along said axis of rotation and having said support shaft housing disposed in said lower arm, said support shaft housing having one end closed by a cap means, a spring means located within said support shaft housing, and an opening within the wall of the support shaft housing to receive a lever which will interact with the said recesses in said support shaft and having a lever housing, in said lower arm, said lever located within said lever housing, said lever urging into said opening within the wall of the support shaft housing by a spring means located between said lever and said lever housing wall;

means for radially rotating the position of the said upper arm about said axis of rotation to multiple positions, the said support shaft housing having at one end thereof one or more apertures in the portion of the support shaft housing which extends above the said lower arm, a locator ball received in each aperture and a securing means encircling the outer radius of the support shaft housing urging the said locator ball against the support shaft, and securing said locator ball in the said depressions on the said support shaft when engaged, securing certain fixed positions of the said armrest and allowing said upper arm to be locked and unlocked rotatably by force exerted rotatably on the said upper chair arm.

* * * * *